US005606901A

United States Patent [19]

Oki

[11] Patent Number: 5,606,901

[45] Date of Patent: Mar. 4, 1997

[54] HYDRAULIC CIRCUIT FOR TURNING PURPOSES

[75] Inventor: Isao Oki, Kanagawa, Japan

[73] Assignee: Kabushiki Kaisha Komatsu Seisakusho, Japan

[21] Appl. No.: 436,373

[22] PCT Filed: Dec. 8, 1993

[86] PCT No.: PCT/JP93/01781

§ 371 Date: May 22, 1995

§ 102(e) Date: May 22, 1995

[87] PCT Pub. No.: WO94/13960

PCT Pub. Date: Jun. 23, 1994

[30] Foreign Application Priority Data

Dec. 8, 1992 [JP] Japan ..... 4-327831

[51] Int. Cl.[6] ..... F15B 11/04; B66C 13/20; E02F 9/22

[52] U.S. Cl. ..... 91/461; 91/464; 91/467; 137/596.12; 137/625.69

[58] Field of Search ..... 91/461, 462, 467; 60/459, 466, 468; 137/596.12, 625.69

[56] References Cited

U.S. PATENT DOCUMENTS

| | | | |
|---|---|---|---|
| 2,971,536 | 2/1961 | Junck et al. | 137/625.69 X |
| 3,151,455 | 10/1964 | Tennis | 91/461 X |
| 3,747,350 | 7/1973 | West et al. | 91/461 X |
| 3,763,746 | 10/1973 | Walters | 91/461 X |
| 4,066,239 | 1/1978 | Hall | 137/625.69 X |
| 4,109,561 | 8/1978 | Junck et al. | 137/625.3 X |
| 4,667,930 | 5/1987 | Latimer et al. | 137/625.69 X |
| 4,776,416 | 10/1988 | Chatterjea et al. | 91/461 X |
| 5,212,950 | 5/1993 | Shirai et al. | 91/461 X |

FOREIGN PATENT DOCUMENTS

| | | | |
|---|---|---|---|
| 51-115329 | 10/1976 | Japan . | |
| 53-21379 | 2/1978 | Japan . | |
| 56-80507 | 7/1981 | Japan | 91/461 |
| 57-107471 | 7/1982 | Japan . | |
| 63-48067 | 4/1988 | Japan . | |
| 2141524 | 12/1984 | United Kingdom | 137/596.12 |

*Primary Examiner*—John E. Ryznic
*Attorney, Agent, or Firm*—Ronald P. Kananen

[57] ABSTRACT

A turning-purpose hydraulic circuit characterized in that a discharge passage (20*a*) of a hydraulic pump (20) is connected to a variable relief valve (21) and a pump port of a directional switching valve (22); a first actuator port and a second actuator port (25, 26) of the said directional switching valve are connected to a turning-purpose hydraulic motor (27); the pilot pressure of a pilot valve (33) is introduced into pressure chambers (31, 32) for controlling a spool in the said directional switching valve and is also introduced into a pressure chamber (40) for controlling a set pressure in the said variable relief valve; a metering-in side portion (42) along which a pressurized oil flows from the said pump port of the said spool to the first or second actuator port is formed with a portion having a configuration such that a flow force may not be produced thereat; and a metering-out side portion (45) along which the pressurized oil flows from the first or second actuator port of the said spool to a tank port is formed with a portion having a configuration such that a flow force may be produced thereat.

5 Claims, 9 Drawing Sheets

HYDRAULIC CIRCUIT FOR TURNING PURPOSES

This application is based upon international application No. PCT/JP93/01781 filed Dec. 8, 1993.

TECHNICAL FIELD

The present invention relates to a hydraulic circuit for turning purposes, that is adapted to supply a pressurized discharge oil of a hydraulic pump to a turning-purpose hydraulic motor for turning the upper vehicle body of a power shovel or the upper turning body off a crane.

BACKGROUND ART

Among the conventional hydraulic circuits for turning a crane, there is known a circuit which, as shown in FIG. 1, is designed to supply a pressurized discharge oil off a hydraulic pump 1 to a turning-purpose hydraulic motor 3 via a directional switching valve 2. The directional switching valve 2 may be a directional switching valve of center-bypassing type in which a spool 6 is fittedly inserted into a spool bore 5 of a valve body 4 as shown in FIG. 2.

In this hydraulic circuit, the spool 6, when lying at a neutral position as shown in FIG. 2, is adapted to unload the pressurized oil from the pump 1 via a center-bypassing passage 7 to a tank 8, while closing between a first and a second actuator port 9 and 10 connected to the turning-purpose hydraulic motor 3 on the one hand and a tank port 11 on the other hand to halt the turning movement of a turning body. When the spool 6 is slidably moved by the operator for switching the directional switching valve 2, the center-bypassing passage 7 is throttled to increase the pump pressure while opening between a turning pump port 12 and the first or second actuator port 9 or 10. If the pump pressure is raised above the drive pressure for turning, the pressurized oil is caused to thrust a check valve (a valve for preventing a reversed flow) 13 open to flow and the return oil from the turning-purpose hydraulic motor 3 flows to the tank 8 after passing between one of the second and the first actuator port 10 and 9, that are opening simultaneously, and the tank port 11. Accordingly, it follows that the turning-purpose hydraulic motor 3 is caused to rotate with a rate of the flow that results by deducing from the pump discharge quantity the flow quantity that is bled off into the tank 8 from the center-bypassing passage 7.

As a matter of course, if the spool 6 is further slidably moved to a full stroke end to completely close the center-bypassing passage 7, the turning-purpose hydraulic motor 3 is rotated by using a full quantity of the pump discharge.

Also, when the hydraulic motor 3 is to be stopped, it is braked by slidably moving the spool 6 in the opposite direction to throttle the opening between the afore-mentioned second or first actuator port 10 or 9 and the tank port 11. The motor 3 is reduced in speed by setting the pressurized oil supplied from the hydraulic pump 1 free into the center-bypassing passage 7. The turning-purpose hydraulic motor 3 is finally stopped by closing between the second or the first actuator port 10 or 9 and the tank port 11.

In this connection, it should be noted that the opening between the afore-mentioned second or first actuator port 10 or 9 and the tank port 11 and the opening of the directional switching valve for the center-bypassing passage 7 vary oppositely to each other.

As in the foregoing, the rate of flow controlled when the turning-purpose hydraulic motor 3 is accelerated is determined depending on how much the quantity of flow from the center-bypassing passage 7 is set free into the tank 8. In other words, when the opening of the center-bypassing passage is larger, the rate of flow into the turning-purpose hydraulic motor 3 is less. And, when the opening of the center-bypassing passage 7 is smaller, the rate of flow into the turning-purpose hydraulic motor 3 is increased.

However, the rate of flow into the turning-purpose hydraulic motor 3 if the pump discharge rate is small is made equal to that in which the quantity set free from the center-bypassing passage 7 is increased if the pump discharge rate is large. Accordingly, it is necessary to further throttle (lessen) the opening of the center-bypassing passage 7 in order that the turning-purpose hydraulic motor 3 may be rotated up to the number of rotations identical to where the pump discharge rate is large. Therefore, the relationship between the spool position and the turning velocity is as represented by the graph in FIG. 3 indicating that at the beginning of flow (motion), the spool position is varied according to the rate of discharge of the pump.

This means that when a suspended load is turned by an operator's operation, the point (the spool position) at which the motion of it is initiated depends upon the number of rotations of an engine connected to the hydraulic pump 1 and thus the point is not constant. Therefore, the operator, while looking for the point at which the movement begins by operating the lever which is provided to control the spool, must find the point of commencement of the motion and then proceed with a gradual acceleration.

Also, when the turning body is to be braked, the turning-purpose hydraulic motor is rotated by the inertia of the turning body including the suspended load, and the braking pressure is increased to reduce the speed by throttling the opening between the second or first actuator port 10 or 9 and the tank port 11 for reducing the return flow quantity. Therefore, because of the need to adjust the braking pressure in accordance with the magnitude of the inertia, the opening between the afore-mentioned second or first actuator port 10 or 9 and the tank port 11 must be adjusted while depending on the experience of the operator.

Accordingly, in case, too, where the turning body is being braked, the operation magnitude of the lever stroke must be adjusted to control the turning velocity in accordance with the weight of the suspended load and the size of the turning radius. The relationship between the spool position and the turning velocity in this case is as represented by the graph of FIG. 4.

When the suspended load is being slightly turned and then stopped by an operator's operation, the opening off the center-bypassing passage 7 is slightly throttled to drive the turning-purpose hydraulic motor 3 and immediately thereafter the return opening, i.e. the opening between the second or first actuator port 10 or 9 and the tank port 11 must be throttled to brake the turning-purpose hydraulic motor 3. However, because the conventional turning-purpose hydraulic motor has the characteristic at the time of acceleration and that at the time of the deceleration which are respectively as shown in the graphs of FIGS. 3 and 4, when the rotation speed of the engine is so slow that the discharge rate of the pump may be small, the difference between the spool position having the characteristic at the time of acceleration and the spool position having the characteristic at the time of deceleration which are as shown in the graph of FIG. 5 is enlarged so that even when an attempt is made by the operator to slightly move and then stop the suspended load by returning the lever at its neutral position, the stoppage of the suspended load is significantly delayed, resulting in an excessive movement thereof and an extreme difficulty by the operator to handle it.

Further, if the turning body is slightly inclined, it is susceptible of receiving the influence of the gravity; and if the boom is long, it is susceptible of receiving the influence of a wind. Thus, even when an attempt is made by the operator to slowly turn the turning body, it tends to accelerate along a downward inclination or to be blown in the wind; hence the turning speed tends to be increased in opposition to the operator's intention.

Also, as disclosed in Japanese Unexamined Patent Publication No. SHO53-21379 there is known a hydraulic circuit which is made capable of controlling the torque and the velocity at the time of acceleration according to the magnitude of the operating magnitude of a pilot valve by using a direction control valve for supplying a pressurized oil to an hydraulic motor, switching the said direction control valve among a first pressurized oil supply position, a neutral position and a second pressurized oil supply position depending on the pilot pressure of the pilot valve and making a relief valve variably settable in accordance with the pilot pressure.

This hydraulic circuit being, however, of the type in which the direction control valve at its neutral position communicates the pump discharge passage and the actuator circuit with the tank, when the hydraulic motor is to be stopped from the state in which it is driven while the direction control valve is taking the first pressurized oil supply position, it is necessary to forcibly stop the hydraulic motor by operating the direction control valve to the second pressurized oil supply position over the neutral position. Hence, if the hydraulic motor is used for turning a crane, the crane cannot be stopped by being accurately positioned.

Further, as disclosed in Japanese Unexamined Patent Publication No. SHO56-80507, there is known a hydraulic circuit which includes a direction control valve for supplying a hydraulic motor with a pressurized discharge oil from a hydraulic pump, in which the direction control valve is switched among a neutral position and a first and a second pressurized oil supply position according to the pilot pressure from a pilot valve and which is provided in the discharge passage of the hydraulic pump with a relief valve whose setting pressure is variable depending on the pilot pressure.

In this hydraulic circuit, there is an interruption between an actuator port and a tank port when the direction control valve lies at the neutral position. Thus, by varying the amount of the slidable movement of the spool towards the neutral position of the direction control valve, the opening areas of the actuator port and the tank port are varied to restrict the return oil flow from the hydraulic motor. This enables the stopping speed of the hydraulic motor to be controlled. However, when tills hydraulic motor is used for turning a crane, if the load or the inertia are varied according to the weight of a suspended load or the like, the rate of passing flow is varied while the afore-mentioned opening areas are made constant. Thus, the slopping speed is made so irregular that the stopping may occur in front of a target position or there may be an overreach before the stopping.

Accordingly, it is an object of the present invention to provide a turning-purpose hydraulic circuit which is capable of acceleration and deceleration in an identical pattern without regard to the weight of a suspended load or the size of a turning radius; eliminates the need for an operator's adjustment regardless of a variation in the speed under the influence of a wind or the inclination of a turning body; and is capable of being controlled by even a beginner at will.

The present inventor has discovered what is described below upon various investigations of crane-turning operations.

More specifically, it has been found that like a crane-turning operation, where the load to a hydraulic motor is small and the acceleration pressure is small, the acceleration must proceed smoothly, and at the time of acceleration, a torque control by the pressure control off a hydraulic motor is more rational than a velocity control by the flow control thereof. In this case, however, since a great initial torque is required at the time of motion commencement, the flow rate must be controlled in such a manner that the pressure is first increased and then an acceleration follows when the movement is commenced while gradually reducing the pressure. When a stationary velocity is reached, the pressure of a magnitude necessary to maintain it must remain applied while the flow rate is controlled. At the time of stopping, it must be done before a target is reached. The operator, while watching the remaining distance and the current velocity, will have to reduce the velocity until the stoppage is reached. When the turning inertia is great, a beginner tends not to reduce the velocity much as he/she is expected and, immediately before the target stop, tends to suddenly reduce the velocity with the consequence of largely jolting the suspended load. Accordingly, for the operator, it is rational to perform the control of the flow rate coupled with a pressure compensation. If so performed, the operation of turning a body independent of the magnitude of the inertia is made possible.

DISCLOSURE OF THE INVENTION

With the foregoing point taken into account and in order to achieve the above and other objects, the present invention provides in one form thereof:

a turning-purpose hydraulic circuit characterized in that a discharge passage of a hydraulic pump is connected to a variable relief valve and a pump port of a directional switching valve; a first actuator port and a second actuator port of the said directional switching valve are connected to a turning-purpose hydraulic; motor; a pilot pressure of a pilot valve is introduced into pressure chambers for controlling a spool in the said directional switching valve and is also introduced into a chamber for controlling a set pressure in the said variable relief valve, a metering-in side portion for flowing a pressurized oil from the said pump port of the said spool to the first actuator port and the second actuator port is formed with a configuration which is incapable of producing a flow force, and a metering-out side portion for flowing the pressurized oil from the first and second actuator ports to a tank port is formed with a configuration which is capable of producing a force flow.

According to this construction, because the flow rate control coupled with the pressure compensation is performed on the metering-out side, it should be noted that the turning motion initiation and stoppage are performed at an identical lever position, the characteristics of the flow rate for the lever position are made identical to each other at the time of acceleration and at the time of deceleration, and the acceleration and the deceleration are carried out in an identical pattern without regard to the weight of a suspended load or the size of a turning radius. Further, because if turning velocity is varied under the inclination of the turning body and the influence of a wind, the spool position itself is automatically adjusted to control the flow rate, an operator is not required to make an adjustment, and even a beginner while watching the remaining distance to the stop and the current velocity, is capable of making the stop at a target position without jolting the suspended load and regardless of the magnitude of the inertia by gradually reducing the velocity.

With the foregoing construction, there is preferably provided a turning-purpose hydraulic circuit characterized in that the relationship between the force acting on the spool and the spring constant k of the spool return spring is as set forth below.

(The Pilot Pressure)×(The Spool Pressure-Receiving Area)=(The Flow Force at The Metering-Out Side)+(The Spring Load of The Spool Return Spring)+ (The Spring Constant k)×(The Opening at The Spool Metering-Out Side)

BRIEF EXPLANATION OF THE DRAWINGS

The present invention will be better understood from the following detailed description and the drawings attached hereto showing a certain embodiment of the present invention.

BEST MODE FOR CARRYING OUT THE INVENTION

Hereinafter, a turning-purpose hydraulic circuit according to one suitable embodiment of the present invention will be described with reference to FIG. 6 through FIG. 11.

Figure 1:
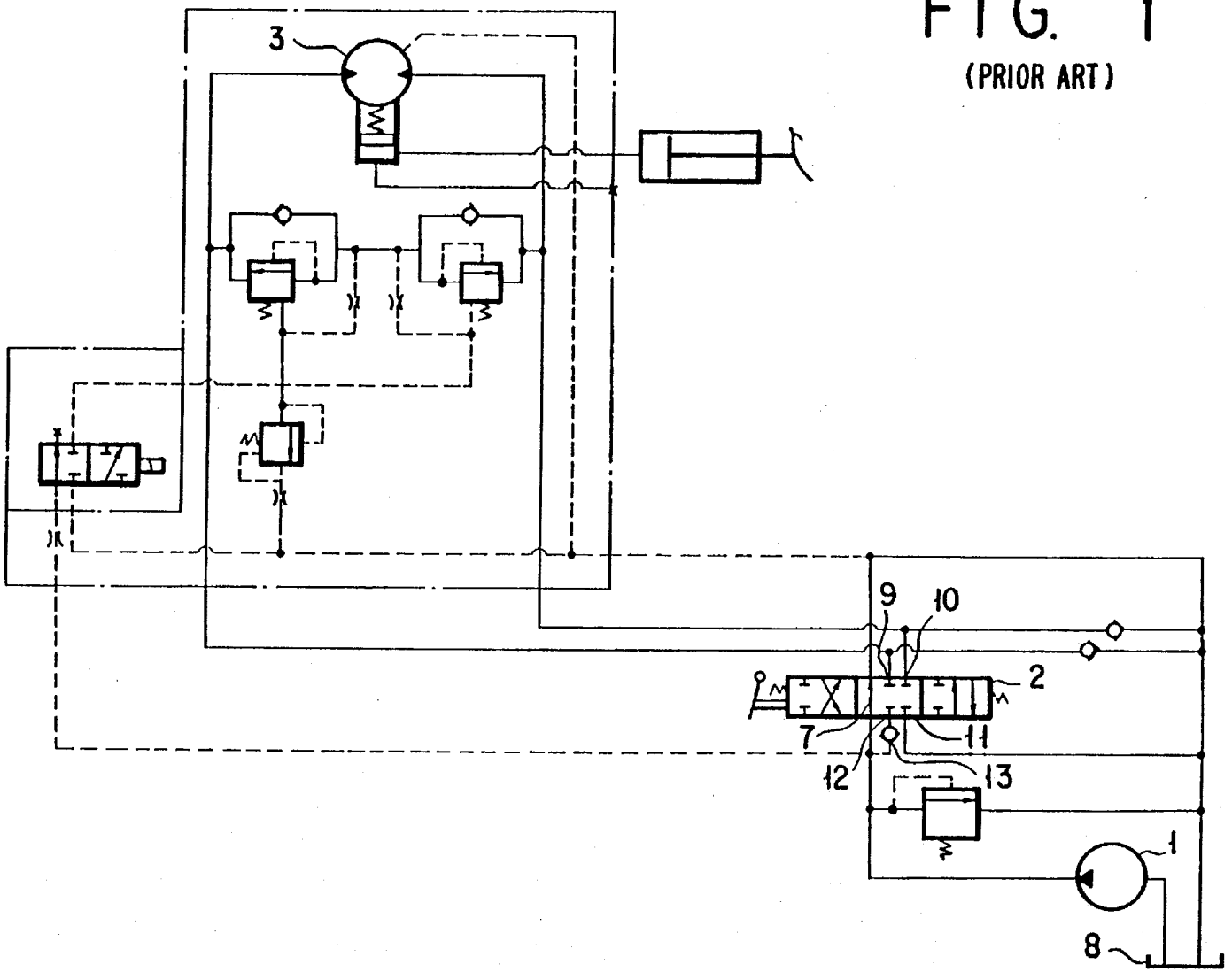
FIG. 1 (PRIOR ART)
FIG. 1 is a circuit diagram illustrating a conventional hydraulic circuit for turning a crane.
Figure 2:
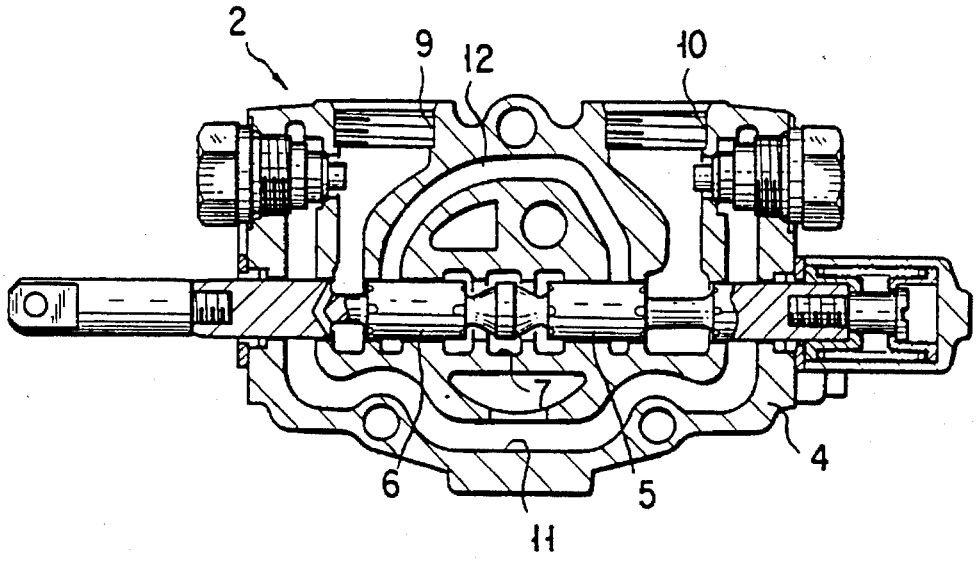
FIG. 2 (PRIOR ART)
FIG. 2 is a cross-sectional view illustrating a directional switching valve in the above-described conventional example.
Figure 3:
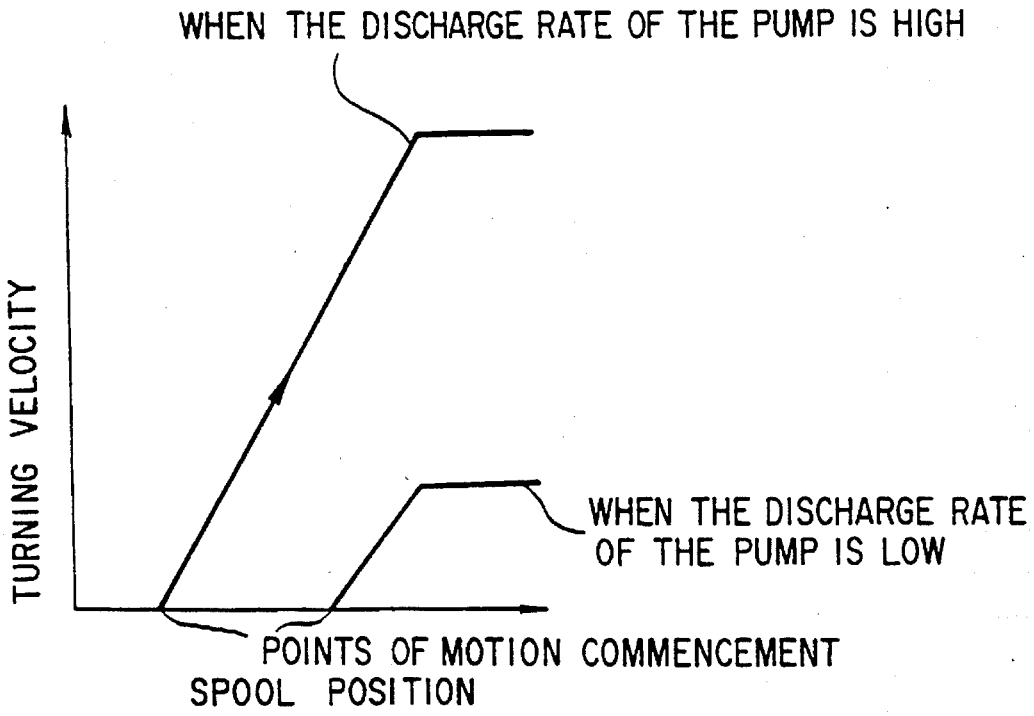
FIG. 3 (PRIOR ART)
FIG. 3 is a graph illustrating the relationship between the spool position and the turning velocity at the time of acceleration in the above-described conventional example.
Figure 4:
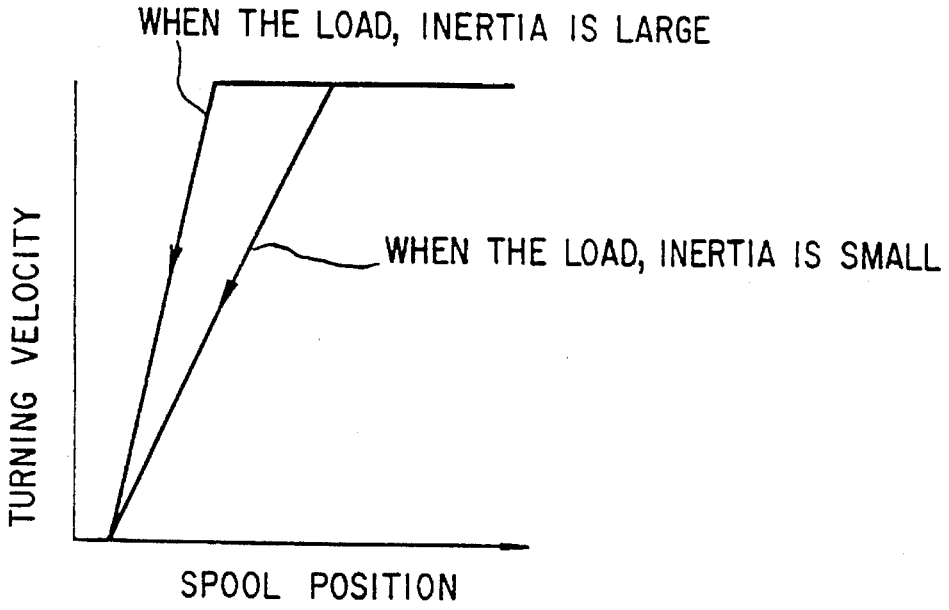
FIG. 4 (PRIOR ART)
FIG. 4 is a graph illustrating the relationship between the spool position and the turning velocity at the time of deceleration in the above-described conventional example.
Figure 5:
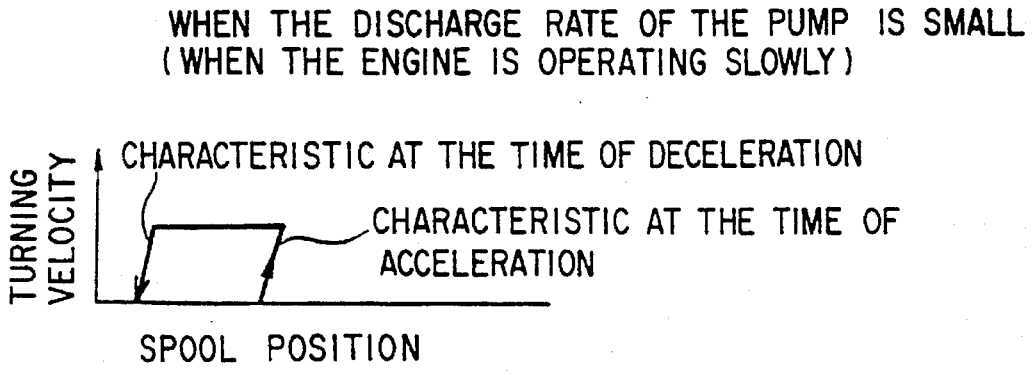
FIG. 5 (PRIOR ART)
FIG. 5 is a graph illustrating the characteristics at the times of acceleration and deceleration when the pump discharge rate is small in the above-described conventional example.
Figure 6:
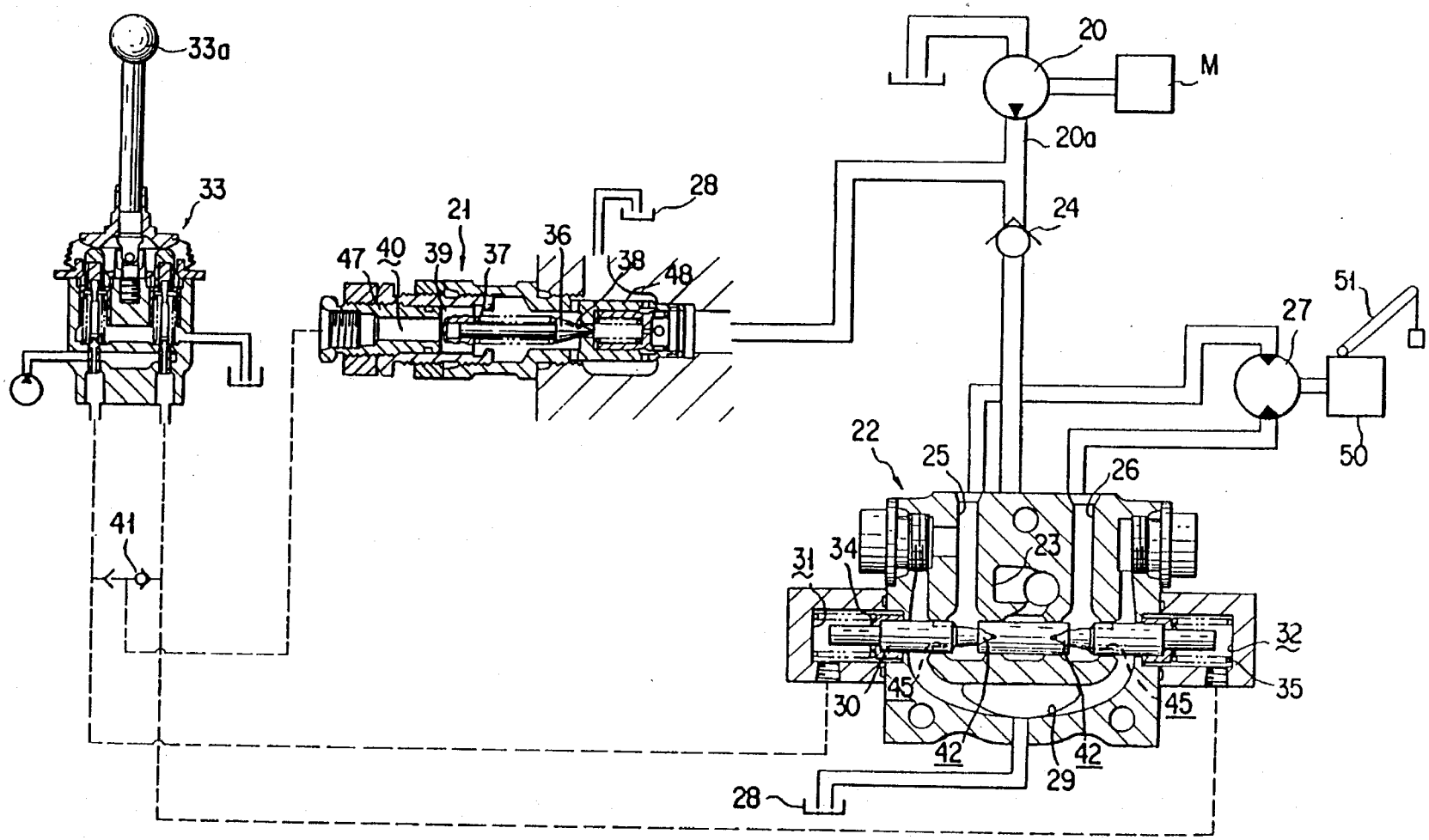
FIG. 6 is a diagrammatic view illustrating the entire construction of one embodiment of the turning-purpose hydraulic circuit according to the present invention.

FIG. 6 illustrates the structure, when a lever lies at its neutral position, of a turning-purpose hydraulic circuit according to the present invention. A discharge passage 20*a* of a hydraulic pump 20 driven by an engine M is connected directly to a variable relief valve 21 and also to a pump port 23 of a directional switching valve 22 via a check valve 24 which constitutes a valve for preventing a reversed flow. The directional switching valve 22 is a directional control valve with four ports and three positions, and its first actuator port 25 and its second actuator port 26 are connected to a turning-purpose hydraulic motor 27. At its neutral position, it is in a closed state between the pump port 23 and the first and second actuator ports 25, 26 and between a tank port 29 which is a return port into a tank 28 and the first and second actuator ports 25, 26.

A spool 30 of the directional switching valve 22 is controlled in its position by delivering a pilot pressure from a pilot valve 33 into spool controlling pressure chambers 31 and 32 located at its both ends. In the said pressure chambers 31 and 32 there are provided springs 34 and 35, respectively, tending to hold the spool 30 at its neutral position.

The afore-mentioned variable relief valve 21 is a pilot-type relief valve in which while a popper 36 of its pilot portion is urged by a spring 37 to a seat 38, the mounting lead (set pressure) of the spring 37 is made variable by varying the position on of a piston 39 slidably mounted at the opposite side to the poppet 36 about the spring 37. For this reason, there is provided a set pressure controlling pressure chamber 40 at the side of one end of the piston 39. Into the said chamber 40, there is supplied an output pressure of the afore-mentioned pilot valve 33 via a shuttle valve 41 adapted to select the higher of the two output pressures of the pilot valve 33.

Figure 7:
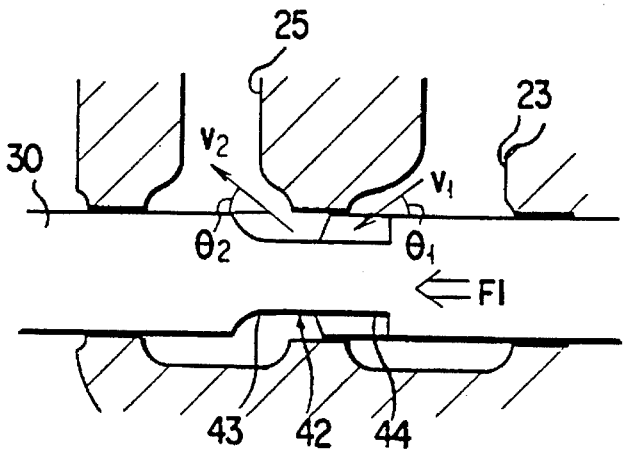
FIG. 7 is a cross-sectional of view a recess portion at the metering-in side of the spool in the above-described embodiment.
Figure 8:
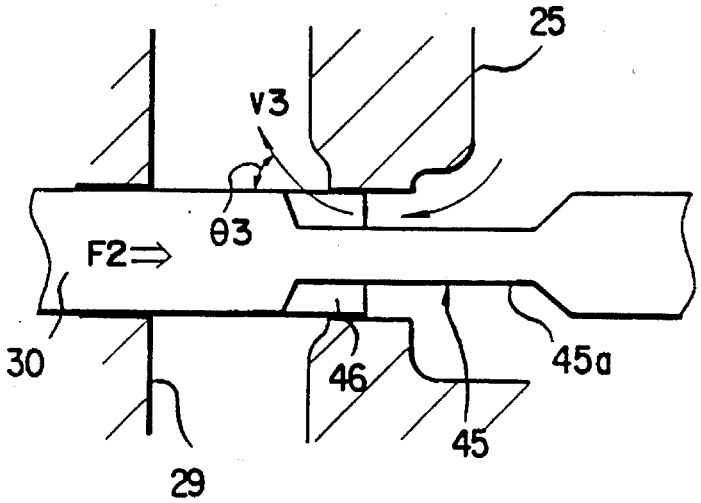
FIG. 8 is a cross-sectional view of a recess portion at the metering-out side of the spool in the above-described embodiment.

The configuration of a portion 42 adapted to communicate and to discommunicate between the pump port 23 of the spool 30 of the afore-mentioned directional switching valve 22 and the first and second actuator ports 25, 26 incorporates, as shown in FIG. 7, a measure for an axial-force compensation with a small-diameter portion 43 and a recess 44. Thus, the portions 42 are so configured as to produce substantially no flow force from the in-flow of the pressurized oil. Also, the configuration of a portion 45 communicating and discommunicating between the first and second actuator ports 25, 26, and the tank port 29 does not incorporate, as shown in FIG. 8, any axial force compensation measure. In the portion 45, a small-diameter portion 45*a* and a recess 46 are provided to produce a substantial flow force in accordance with the opening thereof.

In general, the flow force F produced with such a recess is generated in a direction in which the said recess may be closed, and is expressed by the equation: $F=\rho QV\cos\theta$, where $\rho$ is the density of the fluid, Q is the quantity of flow, V is the velocity of the fluid which flows out through the recess and $\theta$ is the flushing angle of the flowing-out fluid.

Therefore, as the flow rate of the pressurized oil is increased, the flow force will be increased to act in a direction in which the recess may be closed. Also, as the pressure of the first and second actuator port 25, 26 is increased, the flow velocity of the pressurized oil passing therethrough will be increased so that the flow force generated may act in a direction in which the recess may be closed. As a result, the spool 30 will be moved toward the side where the flow rate of the pressurized oil may be reduced.

That is, the configuration of the small-diameter portion 43 of the portion 42 (the metering-in side) along which the fluid flows from the pump port 28 to the first or second actuator ports 25, 26 and the configuration of the recess 44 are, as shown in FIG. 7, designed to have the relationship:

$$F1=\rho Q(V1 \cos \theta 1-V2 \cos \theta 2)\div 0$$

where F1 is the flow force, θ1 is the flow-in angle, θ2 is the flushing angle, V1 is the flow-in velocity and V2 is the flow-out velocity. Thus, it follows that the flow force on the metering-in side will be approximately zero.

Figure 12:
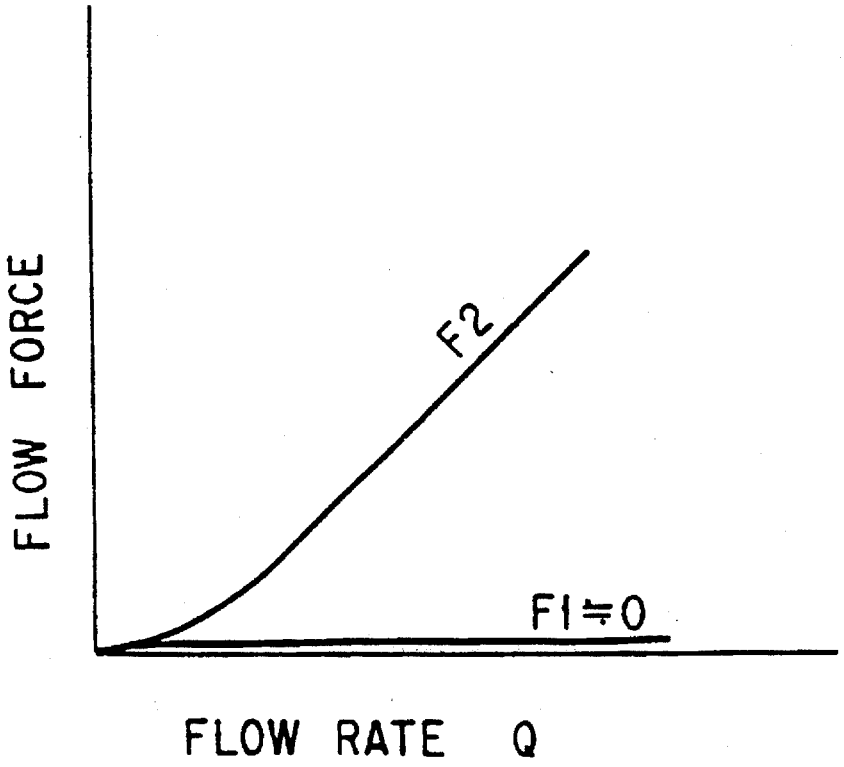
FIG. 12 is a graph illustrating the relationship between the two flow forces F1, F2 and the flow rate Q.

On the other hand, the configuration off the recess 46 of the portion 45 (metering-out side) along which the fluid flows from the first or second actuator 25, 26 to the tank port 29 is, as shown in FIG. 8, designed to have the relationship:

$$F2=\rho QV3 \cos \theta 3$$

where F2 is the flow force, θ3 is the flushing angle and V3 is the flow velocity. A relationship between the above two flow forces F1, F2 and the above flow rate Q is illustrated in FIG. 12. As the recesses 44 and 46 themselves possess, in this way, the characteristics which are capable of controlling the flow rate, the constant k is so selected that there may exist, among the pilot pressure acting on one end of the spool 30, the spool return spring load of the spring 34, 35 on the other side and the above-mentioned flow force, the relationship:

(The Spool End Pressure-Receiving Area)×(The Pilot Pressure)=(The Flow Force on the Metering-Out Side)+(The Spool Return Spring Load)+(The Spring Constant k)×(The Spool Metering-Out Side Opening).

However, it should be noted that the spool metering-out side opening represents the distance of the displacement of the spool from its neutral position.

Figure 9:
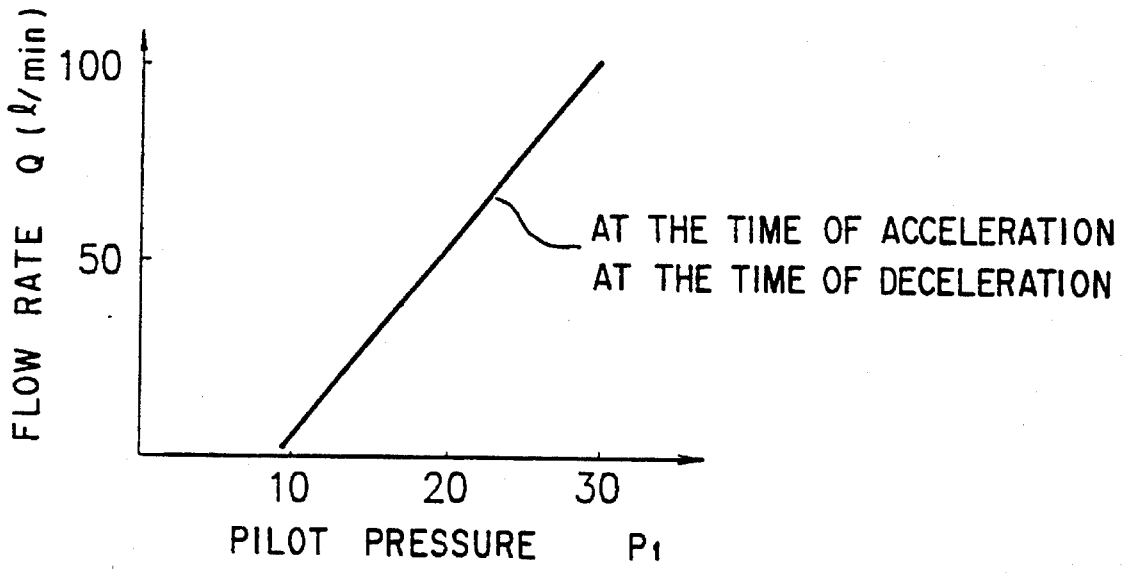
FIG. 9 is a graph illustrating the relationship between the pilot pressure and the flow rate in the above-described embodiment.

For this reason, the flow rate characteristic at the time of acceleration and the flow rate characteristic at the time of deceleration are so controlled by the pilot pressure P1 delivered to the pressure-receiving chamber 31 or 32 that they may be identical to each other, as shown in FIG. 9.

Next, there will be described the operation of this embodiment hereafter.

When the pilot valve 33 lies at its neutral position, if the pressure chamber 40 of the variable relief valve 21 is of a low pressure, the piston 39 is displaced by the spring 37 until it makes a contact with a stopper 47. As a consequence, since the load of the spring 37, too, is small, the popper 36 is lifted under a low pressure, the main valve 48 which is a pilot-type relief valve is also lifted under a low pressure, the pressurized oil from the hydraulic pump 20 remains unloading into the tank 28 via the main valve 48.

Figure 10:
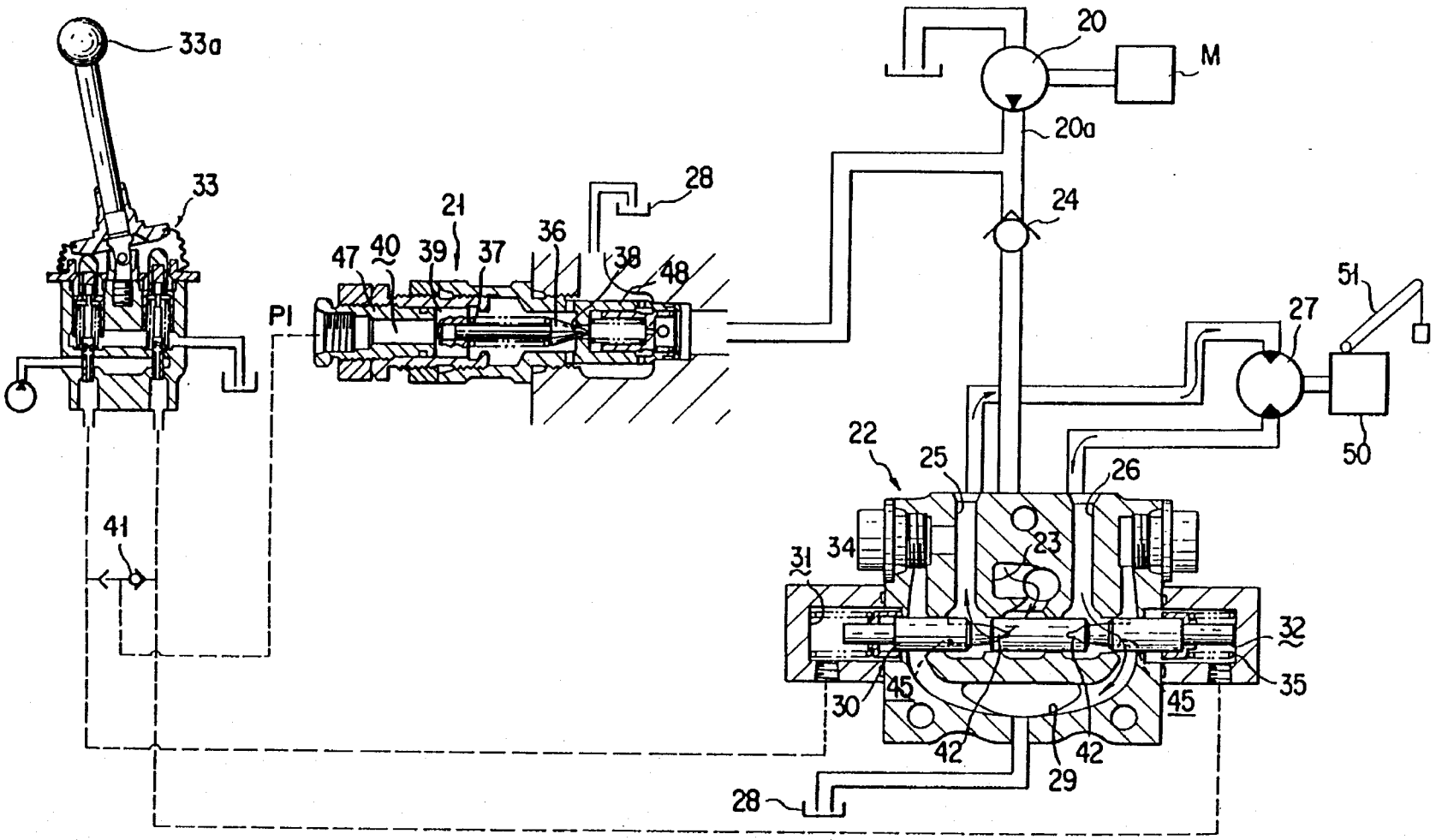
FIG. 10 is a diagrammatic view illustrating an operating condition in the above-described embodiment.

In a next step, if the lever 33*a* of the pilot valve 33 is shifted from its neutral state into an operating state as shown in FIG. 10, the pilot pressure P1 is led to the pressure chamber 31 of the direction switching valve 22 to displace the spool 30 rightwards. This will cause the pressurized oil from the hydraulic pump 20 to thrust the check valve 24 open, to pass through the recess 44 on the metering-in side from the pump port 23 and to be supplied into the turning-purpose hydraulic motor 27 from the actuator port 25. Then, as the return oil from the turning-purpose hydraulic motor 27 is caused to pass through the recess 46 on the metering-out side from the second actuator port 26 and to return into the tank 28 from the tank port 29, there will be created a hydraulic passageway for rotating an inertia body 50 by means of the turning-purpose hydraulic motor 27. In this state, however, the inertia body 50 cannot be turned since the hydraulic pressure is low. Because, however, the pilot pressure P1 is led to the pressure chamber 40 of the variable relief valve 21 through the shuttle valve 41 to thrust the piston 39 and then to enlarge the mounting load of the spring 37, the setting pressure of the poppet 36 is elevated as well. Accordingly, if the pump pressure is increased until such a torque results as is necessary to rotate the inertia body 50, the turning-purpose hydraulic motor 27 will commence rotating as a result.

Furthermore, by adjusting the opening of the recess 46 on the metering-out side, the rotating velocity of the turning-purpose hydraulic motor 27 is controllable, but even a same opening allows the rate of flow passing therethrough to be increased if the pressure within the second actuator port 26 is elevated. Since this recess 46 is off such a configuration that a flow force may readily be produced, however, the flow force F will be produced leftwards if the quantity of flow is increased and tends to throttle the opening of the recess 46 on the thrust-return metering-out side against the thrust force produced rightwards at the left end off the spool 30 by the pilot pressure P1. For this reason, as the spool opening x is reduced, the spring load, too, will be reduced by a magnitude represented by (the spring constant k)×(the opening x) and, as this magnitude of reduction cancels out the magnitude of increasing flow force, it follows that a control of the rate of flow coupled with a pressure compensation is made possible. Accordingly, the operator will be capable of controlling the turning velocity indicated by the lever without regard to the magnitude of the inertia of the turning inertia body 50.

Figure 11:
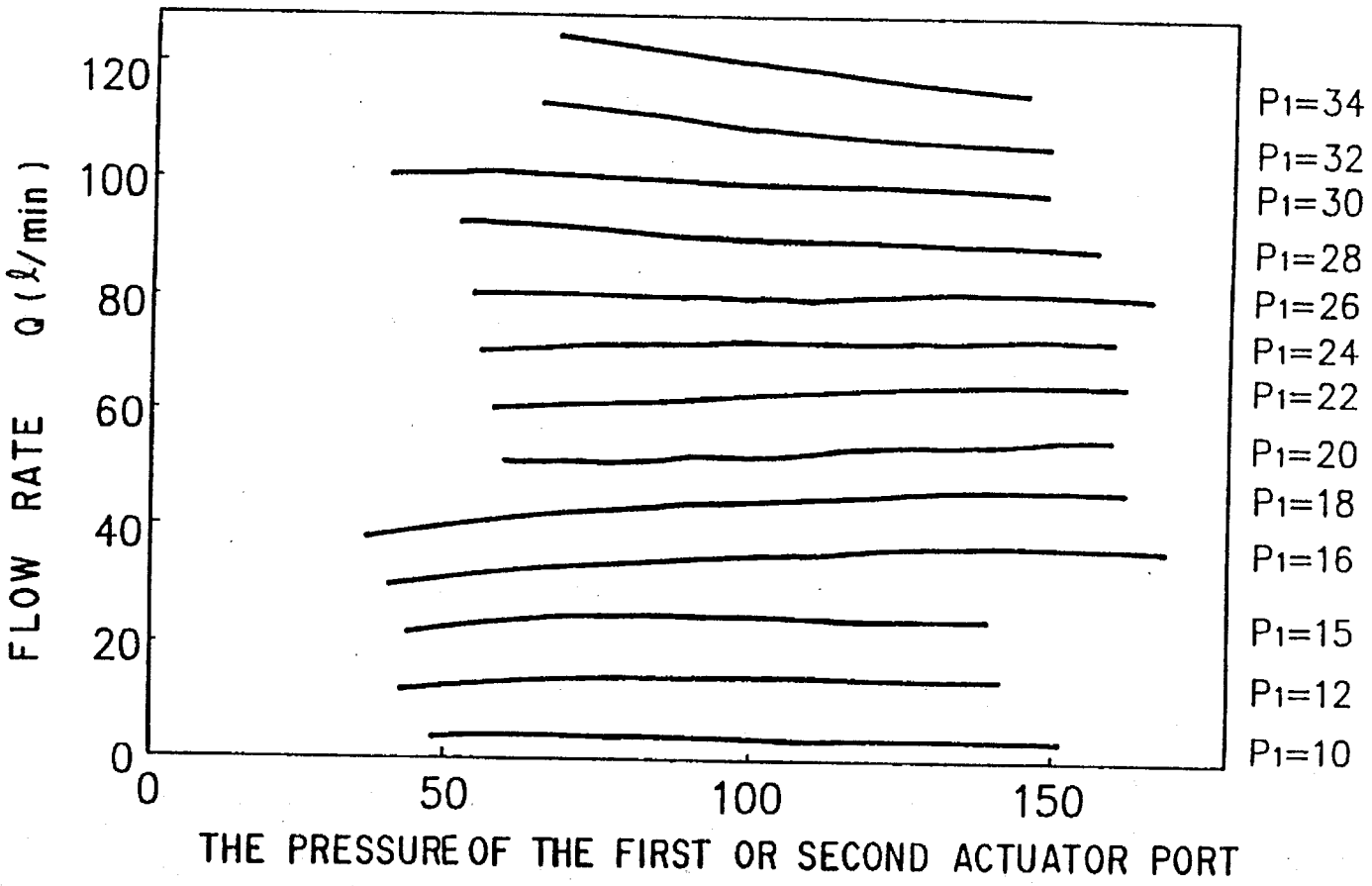
FIG. 11 is a graph illustrating the relationship between the pressure of the first or second actuator port and the flow rate.

At this point, it should be noted that the results of measurement with the pilot pressure taken as a parameter with respect to the relationship between the pressure acting on the second actuator port 26 and the rate of flow are represented in FIG. 11.

In connection with the foregoing, it should also be noted that the mode in which the pilot pressure P1 is supplied into the pressure chamber 32 of the directional switching valve 22 by shifting the lever 33*a* of the pilot valve 33 towards the side opposite to that shown in FIG. 10 is operable in the same manner as described above. The relationship between the pressure acting on the first actuator port 25 and the rate of flow in this case is shown in FIG. 11 as well.

As described hereinbefore, the pilot pressure P1 of the pilot valve 33 is varied for the operation magnitude of lever operated by the operator, and for this pilot pressure P1 the quantity of flow passing through the recess is determined regardless of the pump discharge rate and the load magnitude, as shown in FIG. 11. Accordingly, the point at which the turning body 50 begins to move is made coincident with the point at which the recess 44 begins to open and, since a flow force is not generated at the time of the opening commencement, the point at which the turning body commences to move is made a constant position determined by the pilot pressure P1 and the spring force of the spring. On the other hand, when the turning body 50 is to be stopped, the stopping point of the turning body 50, viz. the point at which it initiates to move is made in coincidence with the closing point of the recess 44, viz. the point at which it initiates to open.

While the present invention has hereinbefore been described with respect to a certain illustrative embodiment thereof, it will readily be appreciated by those skilled in the art to be obvious that many alterations thereof, omissions therefrom and additions thereto can be made without departing from the essence and the scope of the present invention. Accordingly, it should be understood that the present invention is not limited to the specific embodiment thereof set out above, but includes all possible embodiments thereof that can be made within the scope with respect to the features specifically set forth in the appended claims and encompasses all equivalents thereof.

INDUSTRIAL APPLICABILITIES

As has been described hereinbefore, the turning-purpose hydraulic circuit according to the present invention is extremely useful when employed in an apparatus for controlling the delivery of a pressurized oil into a turning-purpose hydraulic motor for driving a turning body of a power shovel or a crane.

I claim:

1. A turning-purpose hydraulic circuit in which a discharge passage of a hydraulic pump is connected to a variable relief valve and a pump port of a directional switching valve; a first actuator port and a second actuator port of said directional switching valve are connected to a turning-purpose hydraulic motor; and a pilot pressure of a pilot valve is introduced into pressure chambers for controlling a spool in said directional switching valve and is also introduced into a pressure chamber for controlling a set pressure in said variable relief valve;

characterized in that:

a metering-in section of said spool through which section the pressurized oil directly flows from said pump port into said first or second actuator port is formed with a first portion having such a configuration that substantially no flow force acting on said spool will be produced at said first portion;

whereas a metering-out section of said spool through which section the pressurized oil directly flows from said first or second actuator port into a tank port is formed with a second portion having such a configuration that a substantial flow force acting on said spool will be produced at said second portion.

2. A turning-purpose hydraulic circuit as set forth in claim 1, characterized in that said pilot pressure is adapted to operate said spool switchably at a pressurized oil supply position and also to so act as to elevate the set pressure of said relief valve.

3. A turning-purpose hydraulic circuit as set forth in claim 1, characterized in that there exists, between a force acting on said spool and a spring constant k of a spool return spring, a relationship that is defined as follows:

(The Pilot Pressure)×(The Spool Pressure-Receiving Area)=(The Flow Force at The Metering-Out Side)+(The Spring Load of The Spool Return Spring)+(The Spring Constant k)×(The Spool Metering-Out Side Opening).

4. A turning-purpose hydraulic circuit as set forth in claim 1, characterized in that:

said configuration at the metering-in side of the spool is designed to have a relationship as follows:

$$F1=\rho Q(V1 \cos \theta 1-V2 \cos \theta 2)\div \text{zero}$$

where $\theta 1$ is a flow-in angle, $\theta 2$ is a flushing-out angle, V1 is a flow-in velocity, V2 is a flow-out velocity and F1 is a flow force; and said configuration at the metering-out side is designed to have a relationship as follows:

$$F2=\sigma QV3 \cos \theta 3$$

where $\theta 3$ is a flushing angle, V3 is a flow velocity and F2 is a flow force.

5. A turning-purpose hydraulic circuit as set forth in claim 1, 2, 3 or 4 characterized that said configuration at the metering-in side and said configuration at the metering-out side of the spool are each constructed to include a small-diameter portion and a recess.

* * * * *